US005293820A

United States Patent [19]

Maejima et al.

[11] Patent Number: 5,293,820

[45] Date of Patent: Mar. 15, 1994

[54] PLATE EXCHANGE APPARATUS FOR PRINTING PRESS

[75] Inventors: Kazuhiro Maejima; Shoichi Ichimura, both of Ibaraki, Japan

[73] Assignee: Komori Corporation, Japan

[21] Appl. No.: 902,697

[22] Filed: Jun. 23, 1992

[30] Foreign Application Priority Data

Jun. 24, 1991 [JP] Japan ..... 3-055980[U]

[51] Int. Cl.[5] ..... B41F 27/12

[52] U.S. Cl. ..... 101/415.1; 101/477

[58] Field of Search ..... 101/216, 415.1, 477, 101/DIG. 36, 485, 486

[56] References Cited

U.S. PATENT DOCUMENTS 4,191,105 3/1980 Ohlsson ..... 101/415.1
4,437,407 3/1984 Wirz et al. ..... 101/415.1
5,094,165 3/1992 Sugiyama et al. ..... 101/DIG. 36

FOREIGN PATENT DOCUMENTS 431575 6/1991 European Pat. Off. ..... 101/415.1

*Primary Examiner*—Edgar S. Burr
*Assistant Examiner*—Stephen R. Funk
*Attorney, Agent, or Firm*—Blakely, Sokoloff, Taylor & Zafman

[57] ABSTRACT

A plate exchange apparatus for a printing press includes a plate holding unit and positioning members. The plate holding unit is supported on frames such that a distal end thereof is movable between an operative position and a retracted position. At the operative position, the distal end of the plate holding unit comes close to plate lockup devices disposed in a gap of a plate cylinder. The distal end of the plate holding unit is retracted from the operative position to the storing position. The positioning members are provided at the distal end of the plate holding unit to be brought into contact with a member on the plate cylinder when the plate holding unit is located at the operative position.

4 Claims, 4 Drawing Sheets

PLATE EXCHANGE APPARATUS FOR PRINTING PRESS

BACKGROUND OF THE INVENTION

The present invention relates to a plate exchange apparatus for a printing press, which exchanges an old plate gripped by a plate lockup device and mounted on the circumferential surface of a plate cylinder for a new plate prepared outside the appearance.

A gap having a length almost equal to the overall length of a plate cylinder is formed in the circumferential surface of the plate cylinder for a printing press. A plate lockup apparatus consisting of a leading-side lockup device for gripping the leading end of a plate and a trailing-side lockup device for gripping the trailing end of the plate, the leading end of the plate being gripped by the leading-side lockup device while the plate is wound around the circumferential surface of the plate cylinder, is fixed on the bottom surface of the gap to extend in the axial direction of the plate cylinder. Each of the conventional leading- and trailing-side lockup devices comprises an elongated lockup table extending in the axial direction of the plate cylinder, a plurality of gripper plates, swingably supported at an edge portion of this lockup table by a plurality of bolts, for gripping or releasing the plate with or from the lockup table by being opened or closed as they swing, and a plurality of cams which can be respectively engaged with notches at the edges of the gripper plates. The plurality of cams are aligned along a pivotal cam shaft. A plurality of compression coil springs are interposed between the lockup table and the gripper plates to bias the gripper plates in an open direction.

With the above arrangement, in order to grip a plate, when the cam shaft is pivoted, the gripper plates are released upon disengagement from the cams and are opened by the elastic forces of the compression coil springs. An end of the plate is inserted between the gripper plates and the corresponding lockup table. When the cam shaft is pivoted in the direction opposite to the direction described above, the gripper plates are pivoted against the elastic forces of the compression coil springs by the behavior of the cams and closed, thereby gripping the end of the plate.

However, in the conventional plate lockup apparatus as described above, the cam shaft must be manually rotated in order to open and close the plate gripper surfaces, as described above. Therefore, the number of processing steps is increased to degrade the operability, resulting in need for much labor, and the preparation time is prolonged to degrade the operating efficiency of the printing press.

Hence, the present applicant developed and proposed a plate exchange apparatus in which a plate holding unit holding a new plate is provided between the printing press units, an old plate removed from the plate cylinder is discharged to and held in the plate holding unit, and the new plate is discharged from the plate holding unit and mounted on the plate cylinder. In this case, however, in order to correctly discharge the old plate removed from the plate cylinder into the plate holding unit and to correctly grip the new plate with the plate lockup device of the plate cylinder, the relative positions of the distal end of the plate holding unit which is swung for plate discharge and plate supply and the plate lockup device must be constantly correctly maintained.

SUMMARY OF THE INVENTION

It is an object of the present invention to provide a plate exchange apparatus for a printing press which constantly correctly holds the relative relationship between a plate holding unit and a plate lockup device during plate exchange.

It is another object of the present invention to provide a plate exchange apparatus for a printing press which has workability improved during plate exchange to improve the operating efficiency of the printing press.

In order to achieve the above objects, according to the present invention, there is provided a plate exchange apparatus for a printing press, comprising a plate holding unit supported on frames such that a distal end thereof is movable between an operative position where the distal end comes close to plate lockup devices disposed in a gap of a plate cylinder and a storing position where the distal end is retracted from the operative position, and positioning members provided at the distal end of the plate holding unit and brought into contact with a member on the plate cylinder when the plate holding unit is located at the operative position.

DETAILED DESCRIPTION OF THE PREFERRED EMBODIMENT

Figure 1:
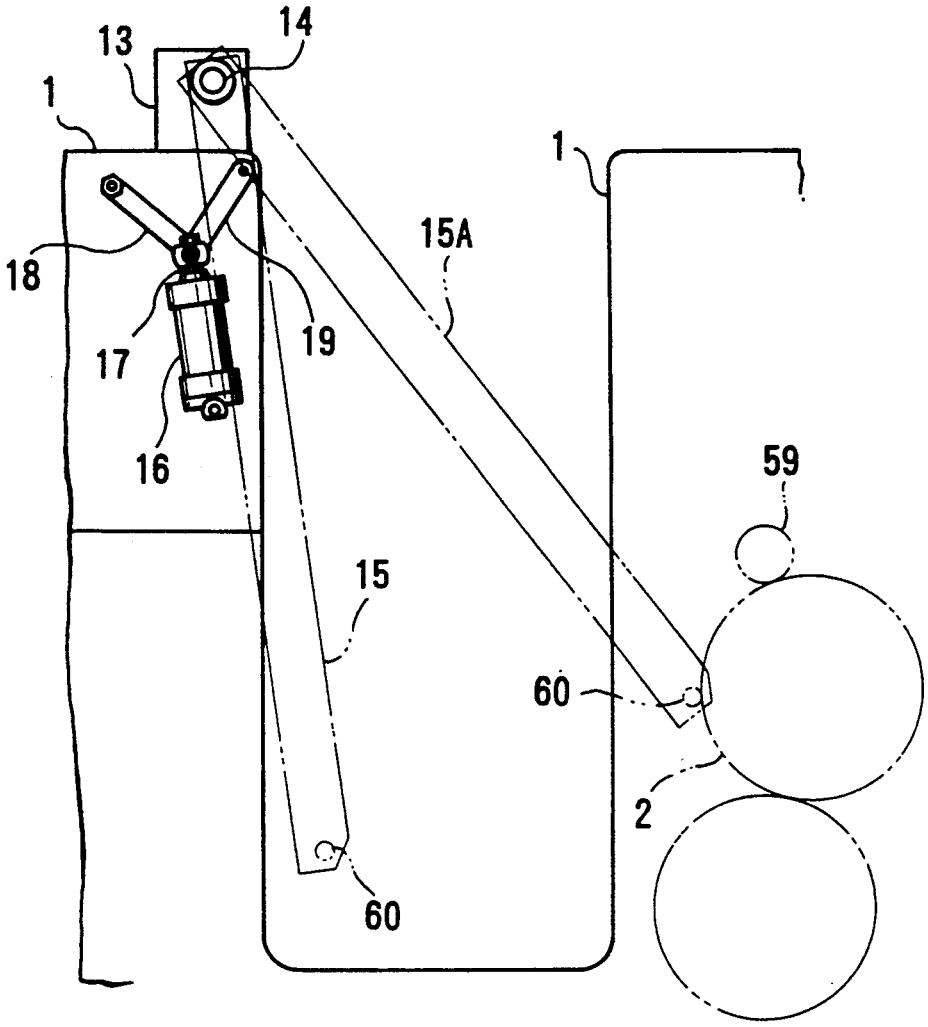
FIG. 1 is a schematic side view of an overall arrangement of a plate exchange apparatus according to an embodiment of the present invention.
Figure 2:
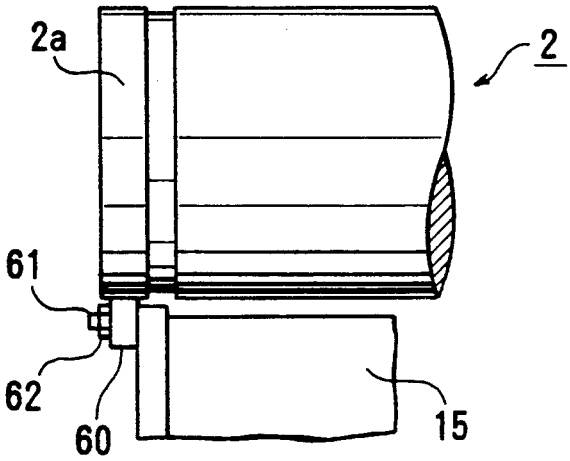
FIG. 2 is a plan view of a plate cylinder shown in FIG. 1.
Figure 3:
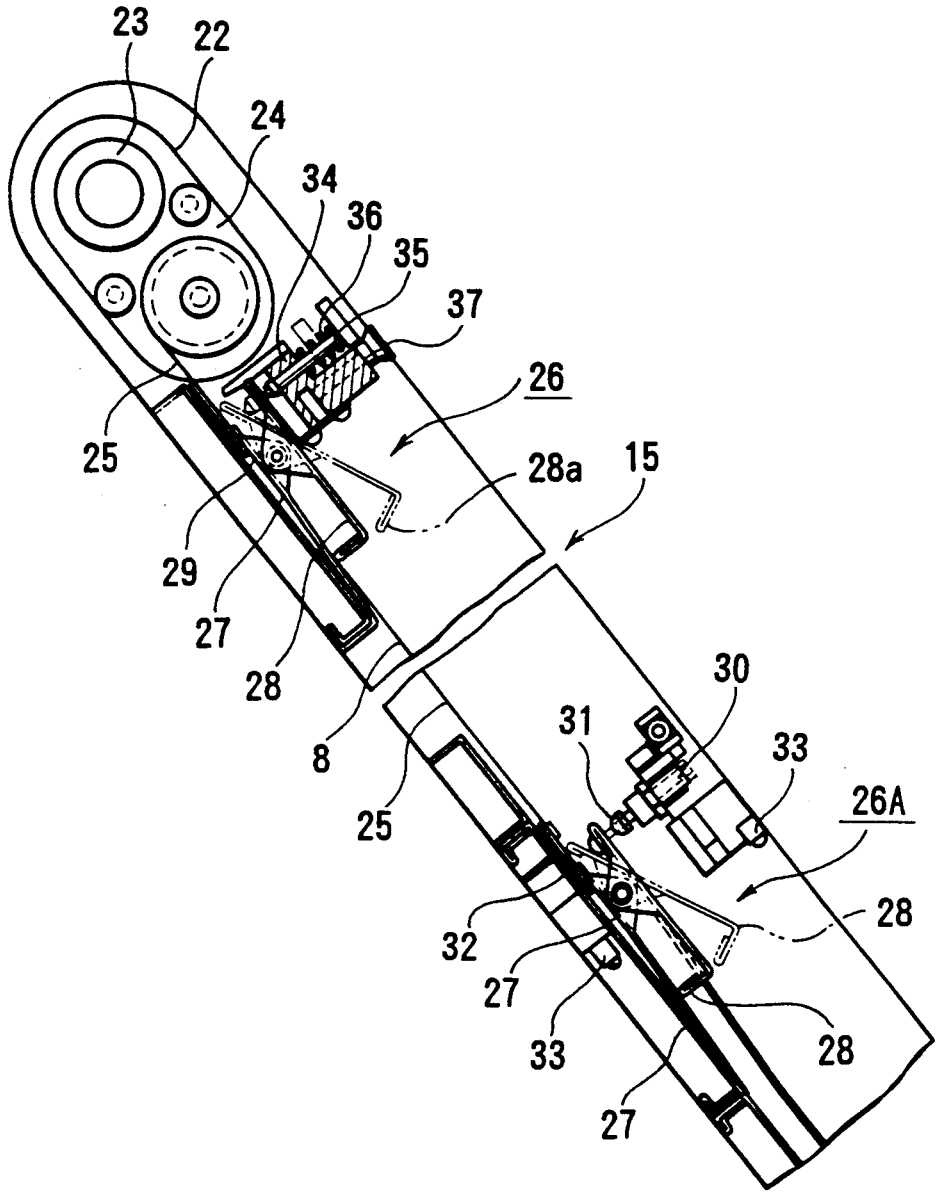
FIG. 3 is a partially cutaway side view of the upper half of a plate holding unit shown in FIG. 1.
Figure 4:
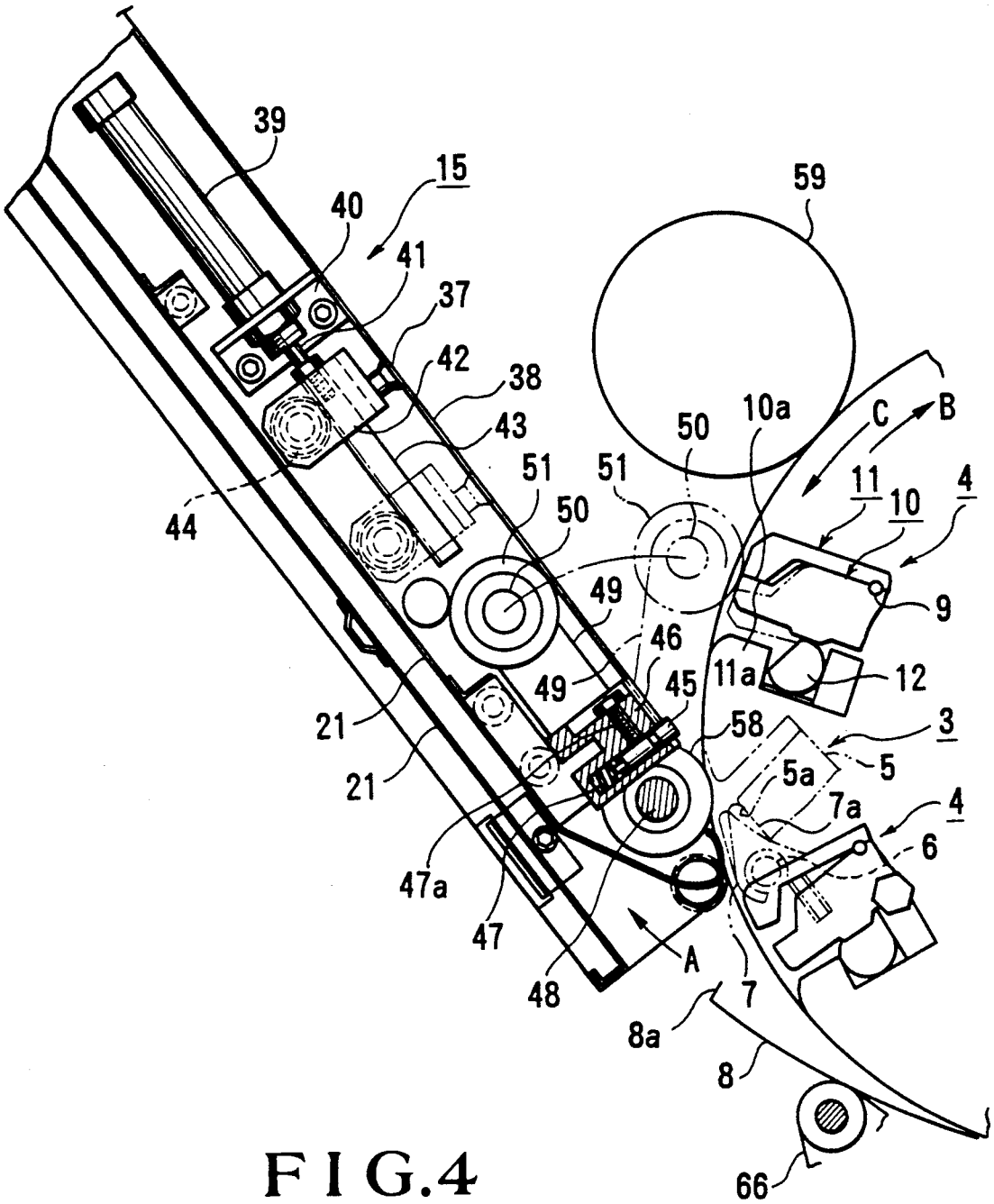
FIG. 4 is a partially cutaway side view of the lower half of the plate holding unit shown in FIG. 1.

FIGS. 1 to 5 show a plate exchange apparatus for a printing press according to the present invention. Referring to FIGS. 1 to 5, a gap (not shown) extending along the overall length of a plate cylinder 2 is formed in the outer circumferential portion of the plate cylinder 2 axially supported by right and left frames 1, and leading- and trailing-side lockup devices 3 and 4 are disposed in the gap, as shown in FIG. 4. The leading-side plate lockup device 3 has a plate lockup table 5 having a substantially square section and extending in the axial direction of the plate cylinder 2, and gripper plates 7 swingably supported on a short shaft 6 of the plate lockup table 5. When the gripper plates 7 are swung by a cam mechanism (not shown), the leading end of a plate 8 inserted between gripper surfaces 5*a* and 7*a* is gripped or released by cooperation of the cam mechanism and a spring member (not shown). The trailing-side plate lockup device 4 has a plate lockup table 10 swingably supported on a shaft 9 and extending in the axial direction of the plate cylinder 2, and gripper plates 11. When a cam 12 of a cam shaft having two ends axially supported by a pair of disk-shaped bearers 2*a* of FIG. 2 is pivoted, the trailing end of the plate 8 inserted between gripper surfaces 10*a* and 11*a* is gripped or released by cooperation with the cam 12 and a spring member (not shown).

The gripper surfaces 5*a* and 7*a* of the leading-side plate lockup device 3 extend in the circumferential direction of the plate cylinder 2, and the gripper surfaces 10*a* and 11*a* of the trailing-side plate lockup device 4 extend in the radial direction of the plate cylinder 2. The leading end of the plate 8 is linear, while its trailing end 8*a* is bent by a plate bender at a right angle, as shown in FIG. 4. Furthermore, the cam mechanism for opening/closing the gripper surfaces of the leading- and trailing-side plate lockup devices 3 and 4 is actuated by an air cylinder (not shown) at a predetermined timing.

When the printing press is a four-color sheet printing press, each printing unit also has a plate exchange apparatus for exchanging a used old plate for a new plate to be used next. More specifically, a pair of right and left brackets 13 are fixed on the upper end faces of frames 1 of each of the second-, third-, and fourth-color printing units, and on the upper end faces of the frames (not shown) provided at a paper discharge unit start portion to be spaced apart from the frames 1 of the fourth-color printing unit such that they are located obliquely above the corresponding plate cylinders 2. Two end portions of a loader shaft 14 are axially pivotally supported by the brackets 13. An elongated loader 15 (to be described later) having almost the same length as that of the plate cylinder 2 when seen from the front and serving as a plate holding member, is fixed to the brackets 13 at its proximal end portion.

Air cylinders 16 connected to a control unit are swingably supported on the right and left frames 1 (including the frames provided at the start portion of the paper discharge unit hereinafter) close to the brackets 13. Levers 18 pivotally mounted on the frames 1 and levers 19 pivotally mounted on the loader 15 are pivotally supported on the operation ends of piston rods 17 of the air cylinders 16. With this arrangement, when the piston rods 17 of the air cylinders 16 are moved forward and backward, the loader 15 is caused to swing, through the levers 18 and 19, between a storing position of the pendent state indicated by reference numeral 15 in FIG. 1 and an operative position of the tilted state indicated by reference numeral 15A in FIG. 1, so that the distal end portion of the loader 15 is moved to be separated from or close to the circumferential surface of the plate cylinder 2, respectively.

The structure of the loader 15 will be described. As shown in FIG. 4, two guide plates 21 forming a V-shaped inlet portion vertically extend in the lower half portion of the loader 15, and the plate 8 which is released upon opening of the trailing-side plate lockup device 4 and fed back upon rotation of the plate cylinder 2 enters between the guide plates 21. In order to support entrance of the plate 8, a guard 66 is provided to serve as a plate guide for preventing erroneous catching of the plate 8 between the plate cylinder 2 and the blanket cylinder.

As shown in FIG. 3, a plurality of pairs of elliptic brackets 22 are provided on the upper end portion of the loader 15 by being fixed by a tubular swingable support shaft 23. The brackets 22 are located at positions to substantially divide the loader 15 into three portions in the widthwise direction. Convex members 24 are supported by the respective pairs of brackets 22. Each convex member 24 has a belt-like leaf spring 25 biased by a spring force in a take-up direction, and a plate trailing end holding unit 26 is fixed on the linear end of the leaf spring 25. An L-shaped plate catch 28, pivotally supported on a holder 27 at the end portion of the leaf spring 25 to be swingable, is provided to the plate trailing end holding unit 26. The plate catch 28 is biased by a torsion coil spring 29 to have an upright posture indicated by a solid line. A bent end of the plate 8 entering between the guide plates 21 is caught by a hook-like portion 28*a* of the plate catch 28. More specifically, prior to start of the plate exchange operation, the entire portion of the plate trailing end holding unit 26 is manually pulled downward to a central wait position of the loader 15 together with the leaf spring 25. When a piston rod 31 of the air cylinder 30 provided at the wait position is moved forward by operating a push button, the plate catch 28 is opened, as indicated by an alternate long and short dashed line, against the elastic force of the torsion coil spring 29. When the holder 27 is urged against a cover 32 by the upper end of the plate catch 28, the entire portion of the plate trailing end holding unit 26 is locked not to move upward against the tensile force of the leaf spring 25.

Reference numeral 33 denotes a sensor comprising a light-emitting unit and a light-receiving unit and provided close to the air cylinder 30. When the sensor 33 detects the leading end of the plate 8 entering between the guide plates 21, the piston rod 31 of the air cylinder 30 is retracted to set the plate catch 28 at the upright position, as indicated by the solid line, by the elastic force of the torsion coil spring 29, and the bent end of the plate 8 is caught by the plate catch 28. Then, the locked state of the holder 27 is released so that the entire portion of the plate trailing end holding unit 26 is moved upward, together with the plate 8, by the tensile force of the leaf spring 25, thereby drawing the plate 8 into the loader 15. A pin 35 is slidably supported in a pin hole of a block 34 provided at the upper end portion of the loader 15 to oppose the plate catch 28. The pin 35 is biased by a compression coil spring 36 which acts to prevent the pin 35 from being depressed When the pin 35 is depressed against the elastic force of the compression coil spring 36, the upper end portion of the plate catch 28 is urged and tilted, as indicated by an alternate long and short dashed line, to release the bent end 8*a* of the plate 8 to be removed from the loader 15.

A plate supply unit will be described. As shown in FIG. 4, a plurality of stages of suction pads 37 (three stages in this embodiment; the middle stage is not shown) are provided on the surface of the loader 15. Each stage comprises a plurality of suction pads 37, and the suction pads 37 are connected to vacuum air sources to draw, by vacuum, a new plate 38 which is to be supplied to the plate cylinder 2 in place of the old plate. The lower-stage suction pads 37 are movable in the vertical direction. More specifically, a pair of right and left air cylinders 39 are supported on the two side boards of the loader 15 through brackets 40, and the suction pads 37 are mounted to be aligned on bars 42 having two ends fixed to piston rods 41 of the air cylinders 39. When the piston rods 41 are moved forward, the bars 42 holding the new plate 38 are moved from a position indicated by a solid line to a position indicated by an alternate long and short dashed line in FIG. 4, and the new plate 38 is supplied to the leading-side plate lockup device 3 which is open to oppose the distal end of the new plate 38.

Reference numeral 43 denotes a rack fixed on the corresponding side board of the loader 15 to engage with a pinion 44 at the corresponding end of the bar 42, thereby smoothing retraction of this bar 42. Reference numeral 45 denotes a reference pin slidably fitted in a pin hole of another bar 46. The reference pin 45 is biased by a compression coil spring 47 in a projecting direction to be fitted in a reference hole in the new plate 38 to position the new plate 38. The reference pin 45 is locked by a bolt 47*a* while it is inserted in the pin hole.

Figure 5:
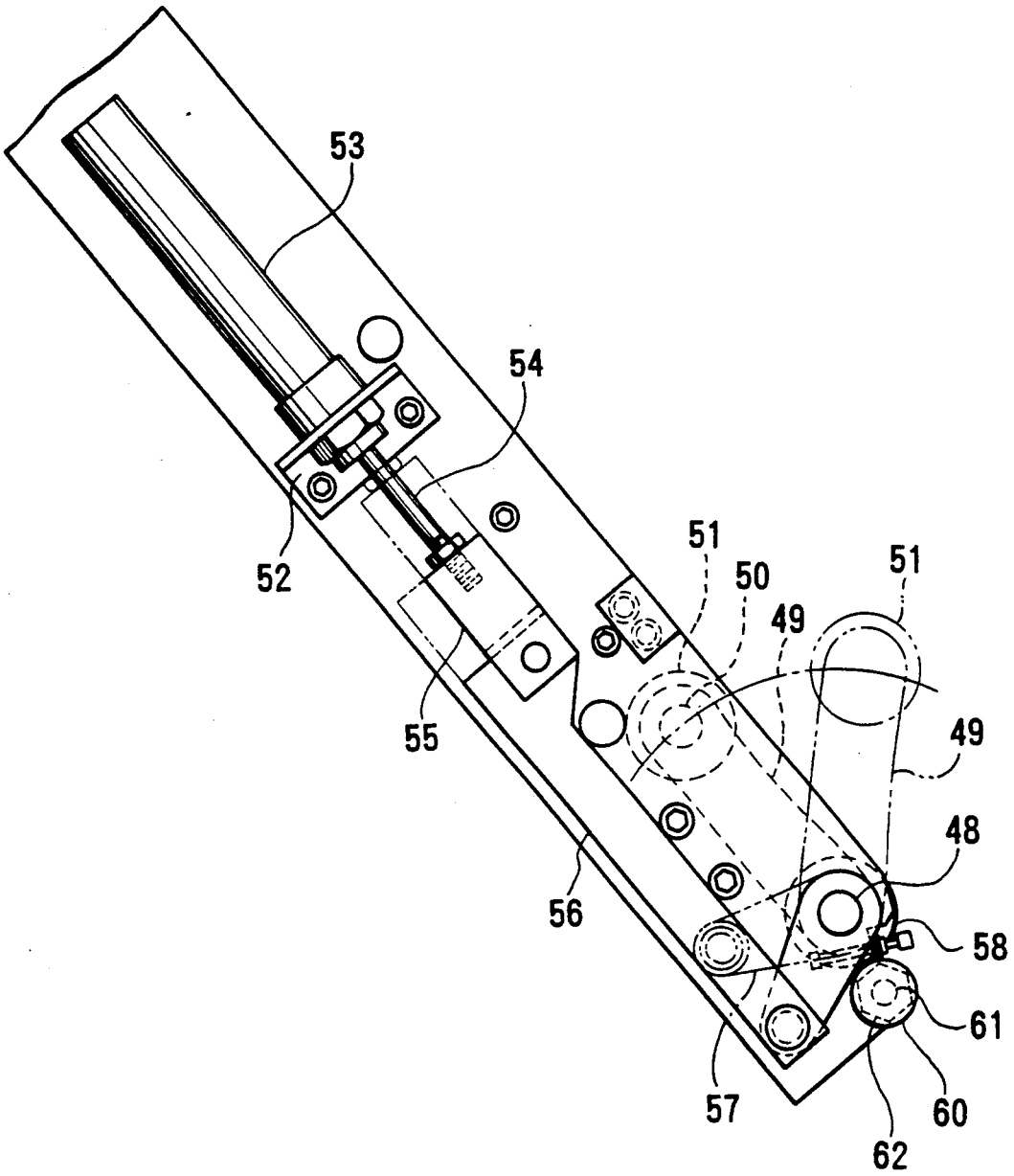
FIG. 5 is a side view of the plate holding unit shown in FIG. 1.

As shown in FIG. 5, an arm shaft 48 is pivotally provided to extend between the two side boards at the lower end portion of the loader 15. A pair of right and left arms 49 are fixed on the projecting portions on two sides of the arm shaft 48 of the loader 15. A roller shaft 50 is stationarily supported between the free end portions of the arms 48, and a plurality of press rollers 51 constituted by, e.g., rubber or brush members, are pivotally aligned on the roller shaft 50. An air cylinder 53 is fixed on one end of the widthwise direction of the loader 15 through a bracket 52, a lever 56 is fixed to the operating end of a piston rod 54 of the air cylinder 53 through a connecting plate 55, and the free end of a lever 57 fixed to the arm shaft 48 is pivotally mounted on the lower end portion of the lever 56. With this arrangement, when the piston rod 54 of the air cylinder 53 is retracted, the arms 49 are pivoted between a storing position indicated by a solid line and a use position indicated by an alternate long and short dashed line in FIG. 4. At the use position indicated by the alternate long and short dashed line in FIG. 4, the press rollers 51 are urged against the new plate 38 on the plate cylinder 2 to bring the new plate 38 into tight contact with the circumferential surface of the plate cylinder 2 and to insert the bent end of the new plate 38 in the open trailing-side plate lockup device 4.

A plurality of guide rollers 58 constituted by, e.g., rubber or brush members are aligned on the arm shaft 48 to slidably contact the new plate 38 supplied to the plate lockup device 4, thereby guiding the new plate 38. Reference numeral 59 denotes a form roller in contact with the plate surface of the plate cylinder 2 to apply ink on the plate surface. Generally, four or more form rollers 59 are provided.

In this apparatus, a pair of right and left rollers 60 serving as the positioning members are pivotally mounted on the side boards at the distal end of the loader 15 to be capable of being rotated by pins 61 and nuts 62. When the loader 15 is tilted to the operative position indicated by reference numeral 15A in FIG. 1, the rollers 60 are urged against the circumferential surfaces of the pair of bearers 2*a* provided at two end portions of the plate cylinder 2 to correctly position the loader 15.

The respective components having the above arrangements and, e.g., a servo motor for rotating the plate cylinder 2 are connected to a control unit (not shown), and the respective components and the servo motor are operated at predetermined timings.

The operation of the plate exchange apparatus having the plate holding unit as described above will be described. During the printing operation, the loader 15 fixed to the loader shaft 14 suspends from the brackets 13. In this state, the new plate 38 is drawn by the plurality of stages of suction pads 37, and the reference hole of the new plate 38 is fitted on the reference pin 45, thereby positioning and loading the new plate 38 in the loader 15. When the plate holding unit 26 in the loader 15 is manually pushed up and the air cylinder 30 is actuated by a push button operation, the piston rod 31 is moved forward to push the plate catch 28, thereby tilting and opening the plate catch 28, as indicated by the alternate long and short dashed line in FIG. 3.

To exchange the old plate 8 for the new plate 38 after the printing operation is completed, when a start button is depressed, the air cylinders 16 are actuated to tilt the loader 15 to a plate exchange position, indicated by reference numeral 15A in FIG. 1, through the levers 18 and 19. The servo motor is rotated through a predetermined angle until the plate cylinder 2 reaches a plate discharge position, and then stopped. In this case, since the loader 15 is stopped while the rollers 60 are urged against the circumferential surfaces of the bearers 2*a* of the plate cylinder 2, the leading-side plate lockup device 4 and the distal end portion of the loader 15 are correctly positioned in the radial direction of the plate cylinder 2. The cam 12 is pivoted by a drive unit (not shown) to open the leading- and trailing-side plate lockup devices 3 and 4 simultaneously.

In this state, the trailing end of the old plate 8 is ejected from the trailing-side plate lockup device 4 by its rigidity to abut against the guard 66. After this, since the plate cylinder 2 is rotated in a direction of an arrow B in FIG. 4, the trailing end of the old plate 8 enters between the guide plates 21 of the loader 15. The guard 66 prevents the plate from being caught between the plate cylinder 2 and the blanket cylinder and is used as a plate guide. When the entered old plate 8 passes the sensor 33, the sensor 33 detects it and actuates the air cylinder 30 to retract the piston rod 31, thereby setting the plate catch 28 upright, as indicated by the solid line in FIG. 3. As a result, the plate catch 28 catches the bent end 8*a* of the old plate 8, and the locked state of the holder 27 is disengaged. The entire portion of the plate trailing end holding unit 26 is moved upward by the tensile force accumulated in the leaf spring 25 provided to the convex members 24, and the old plate 8 held by the plate catch 28 is drawn into and stored in the loader 15.

When plate discharge is completed in this manner, the servo motor is operated to slightly rotate the plate cylinder 2, and the open plate gripper surfaces 5*a* and 7*a* of the leading-side plate lockup device 3 are stopped when they reach a position on an extension line of the new plate 38 held by the loader 15, as shown in FIG. 4. At this time, since the rollers 60 are urged against the circumferential surfaces of the bearers 2*a* of the plate cylinder 2, the distal end of the loader 15 and the leading-side plate lockup device 3 are correctly positioned in the radial direction of the plate cylinder 2. At this time, the air cylinders 39 are actuated to move the bars 42 downward while rotating the pinions 44 on the racks 43. Thus, the new plate 38 held by the lower-stage suction pads 37 is moved downward by being guided by the guide rollers 58, having circumferential surfaces opposing the moving path of the new plate 38, in slidable contact with the guide rollers 58, and the leading end of the new plate 38 is inserted in the leading-side plate lockup device 3. At this time, when the air cylinders for opening/closing the plate lockup device are actuated, the cam 12 or the like is pivoted and the new plate 38 is gripped by the leading-side plate lockup device 3.

In this state, the servo motor is driven to rotate the plate cylinder 2 in a direction of an arrow C, and the new plate 38 is wound on the circumferential surface of the plate cylinder 2 and stopped when its bent end opposes the press rollers 51. Since the plate cylinder 2 is rotated while the guide rollers 58 are urged against the surface of the new plate 38, the new plate 38 is brought into tight contact with the circumferential surface of the plate cylinder 2. Thereafter, the air cylinder 53 is actuated to retract the piston rod 54, and the arms 49 are pivoted through the levers 56 and 57 to urge the press rollers 51 constituted by, e.g., rubber or brush members against the circumferential surface of the plate cylinder 2, thereby inserting the bent end of the new plate 38 in the trailing-side plate lockup device 4 by the press rollers 51. In this case, the bent end of the new plate 38 correctly coincides with the opening of the trailing-side plate lockup device 4 and is thus reliably gripped. When the trailing end of the new plate 38 is inserted in the trailing-side plate lockup device 4, the air cylinder is actuated, and the cam 12 is pivoted to close the trailing-side plate lockup device 4, thereby gripping the inserted end of the new plate 38. In the final pivot period of the cam 12, since the plate lockup table 10 and the gripper plates 11 are integrally moved in the circumferential direction of the plate cylinder 2, the new plate 38 becomes taut and is brought into tight contact with the circumferential surface of the plate cylinder 2.

Thereafter, the air cylinder 53 is actuated to store the press rollers 51, and the piston rods 17 of the air cylinders 16 are retracted to pull the levers 18 and 19. As a result, the loader 15 suspends in the storing state, and the printing operation can be resumed.

After the printing operation is resumed, when a user stands in front of the loader 15 at an appropriate occasion and depresses the pin 35, the plate catch 26 is tilted to release the old plate 8. Hence, the user can remove the old plate 8 from the loader 15, and can load and prepare the new plate 38 in the loader 15 during the printing operation, as described above.

In this embodiment, the rollers 60 and the bearers 2*a* are in contact opposite to each other as members for positioning the loader 15 in the radial direction of the plate cylinder 2. However, the present invention is not limited to this, and any members can be employed as far as they consist of a member on the loader 15 and a member on the plate cylinder 2 that are in contact with each other. Furthermore, in this embodiment, the loader 15 holds both the old plate 8 and the new plate 38. However, the loader 15 may hold only either the old or new plate 8 or 38.

As is apparent from the above description, according to the present invention, in a plate exchange apparatus for a printing press, a plate holding unit for holding at least one of a plate discharged from a plate cylinder and a plate to be supplied to the plate cylinder is swingably supported on frames to be movable between an operative position where the distal end of the loader is in contact with the plate lockup devices and a storing position where the distal end is retracted from the operative position. Positioning members, which are in contact with the plate cylinder-side member when the plate holding unit is at the operative position, are provided to the distal end portion of the plate holding unit. Hence, during plate exchange, the relative positions of the distal end of the plate holding unit and the plate lockup devices in the radial direction of the plate cylinder are constantly correctly maintained regardless of rotation of the plate cylinder. As a result, a correct plate exchange operation is performed, and the function of the apparatus is improved.

What is claimed is:

1. A plate exchange apparatus in combination with a printing press, said printing press comprising a frame including at least one plate cylinder for holding a printing plate, with said printing plate having two end portions and a disk-shaped bearer disposed on each of said end portions of said plate cylinder, said bearers each having a circular circumferential surface, said plate exchange apparatus comprising:

a plate holding unit having a proximate end and a distal end, said plate holding unit being movably supported on said frame of said printing press;

driving means for moving said distal end of said plate holding unit between an operative position where said distal end is moved adjacent to plate lockup devices disposed in a gap of said plate cylinder and a stored position where said distal end is retracted from said operative position; and positioning members disposed on said distal end of said plate holding unit, said positioning members being urged into constant contact with said circumferential surfaces of said bearers when said plate holding unit is moved to said operative position and said plate cylinder is rotated.

2. An apparatus according to claim 1, wherein said positioning members comprise rollers rotatably supported on said distal end of said plate holding unit to provide mutual rotation between said rollers and said disk-shaped bearers.

3. An apparatus according to claim 2, wherein said rollers maintain a correct radial orientation relative to said plate lockup devices for enabling said plate exchange apparatus to automatically align said distal end of said plate holding unit with said plate lockup devices upon release and engagement of printing plates by said plate lockup devices during plate exchange.

4. An apparatus according to claim 1, wherein said plate holding unit comprises at least one of a plate discharge unit and a plate supply unit.

* * * * *